US006415717B1

(12) United States Patent
Sanford et al.

(10) Patent No.: US 6,415,717 B1
(45) Date of Patent: Jul. 9, 2002

(54) LINE CHARGE ASSEMBLY AND SYSTEM FOR USE IN SHALLOW-WATER CLEARING OPERATIONS

(75) Inventors: Matthew J. Sanford, Bel Alton, MD (US); Keith B. Lewis, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/784,204

(22) Filed: Feb. 16, 2001

(51) Int. Cl.[7] ..... F42B 33/06; F42C 15/24

(52) U.S. Cl. ..... 102/302; 102/403; 102/223; 102/250

(58) Field of Search ..... 102/302, 402, 102/403, 223, 224, 250

(56) References Cited

U.S. PATENT DOCUMENTS

| | | | | | |
|---|---|---|---|---|---|
| 2,967,504 | A | * | 1/1961 | Atanasoff et al. | 102/302 X |
| 3,114,316 | A | | 12/1963 | Littleton | 102/22 |
| 3,242,862 | A | | 3/1966 | Stegbeck et al. | 102/22 |
| 4,542,694 | A | * | 9/1985 | Wells | 102/223 X |
| 4,658,726 | A | * | 4/1987 | Held | 102/223 X |
| 4,938,136 | A | * | 7/1990 | Gould | 102/402 X |
| 5,375,525 | A | | 12/1994 | Greenslade et al. | 102/254 |
| 5,437,230 | A | | 8/1995 | Harris et al. | 102/302 |
| 5,524,524 | A | | 6/1996 | Richards et al. | 89/1.13 |
| 5,546,862 | A | * | 8/1996 | Schabdach | 102/302 |
| 5,675,104 | A | | 10/1997 | Schorr et al. | 89/1.13 |
| 6,101,916 | A | * | 8/2000 | Panot et al. | 102/402 X |
| 6,182,553 | B1 | * | 2/2001 | Peterson | 102/403 |
| 6,286,431 | B1 | * | 9/2001 | Cangelosi | 102/402 |

OTHER PUBLICATIONS

US 6,308,633, 10/2001 Grosch et al. (withdrawn)*.

* cited by examiner

*Primary Examiner*—Peter A. Nelson
(74) *Attorney, Agent, or Firm*—James B. Bechtel, Esq.; Peter J. Van Bergen, Esq.

(57) ABSTRACT

A line charge assembly and system are provided for use in a shallow-water obstruction clearing operation. Each assembly has a propulsion unit capable of flight through the air, a line charge array, an air-safed water-armed fuze, a first interrupter disposed between the line charge array and the fuze, and a second interrupter disposed in the line charge array. The line charge array is defined by a plurality of line charges successively coupled to one another by a detonation line capable of transferring detonation energy therealong successively to each line charge. The line charge array has a first end coupled to the propulsion unit and has a second end coupled to the first interrupter. The fuze generates the detonation energy at the expiration of a first time period provided the fuse is in water. The first interrupter permits the detonation energy to be transferred from the fuze to the second end of the line charge array until the expiration of a second time period. The second interrupter permits the detonation energy to be transferred therethrough until the expiration of a third time period. The first time period expires before the expiration of the second and third time periods. The first interrupter operates independently of the fuze to essentially sterilize a dud fuze. The second interrupter operates independently of the fuze and first interrupter to prevent the back propagation of sympathetic detonation energy to any of the assembly's line charges that reside between it's fuze and the first interrupter in the case where the fuze is a dud.

27 Claims, 3 Drawing Sheets

LINE CHARGE ASSEMBLY AND SYSTEM FOR USE IN SHALLOW-WATER CLEARING OPERATIONS

ORIGIN OF THE INVENTION

The invention described herein was made in the performance of official duties by employees of the Department of the Navy and may be manufactured, used, licensed by or for the Government for any governmental purpose without payment of any royalties thereon.

CROSS-REFERENCE TO RELATED PATENT APPLICATIONS

This patent application is co-pending with one related patent application entitled "LINE CHARGE ASSEMBLY AND SYSTEM FOR USE IN SHALLOW-WATER CLEARING OPERATIONS" (Navy Case No. 82565), by the same inventors as this patent application.

FIELD OF THE INVENTION

The invention relates generally to systems for clearing mines and other obstructions from a shallow-water area, and more particularly to a line charge assembly and system used to clear a shallow-water area that is automatically disabled after a prescribed period of time during which detonation does not occur and that is equipped to prevent sympathetic detonation of any of such assemblies having a dud fuze.

BACKGROUND OF THE INVENTION

Surf zone mine clearing operations involve the placement of a large number of charges over an area that will define a safe lane of travel for follow-up traffic. Ideally, these charges are placed from a safe stand-off distance, are reliably detonated, and rendered inoperable if they do not detonate. One system being considered for these operations is a line charge assembly that is launched from a watercraft into a surf zone. A number of such assemblies would be deployed and then detonated to clear mines and other obstructions from an area. Following detonation, another set of line charge assemblies would be deployed in an area adjacent to the just-cleared area. To ensure total clearing, the area to be cleared is defined to partially overlap the area just cleared. However, this system presents two substantial problems.

The first problem is inherent to any explosive system. That is, each line charge assembly must be fuzed to prevent its unintended detonation during shipping, storage and deployment. Further, the fuze must initiate detonation only at a specified time and in specified conditions, and is still further required (by a variety of ordinance guidelines and standards) to disable any possible detonation after the specified time period has lapsed. Thus, the fuze must be "safed" if it is a dud where "safed" means that the fuze's primary energetic components cannot transfer detonation energy to the fuze's explosive train that contains less energetic materials.

The second problem is one brought about by the nature of the above-described operation. Specifically, when a watercraft is to deploy line charge assemblies in an area that is adjacent to a just-cleared area, the watercraft may have to enter the just-cleared area in order to deploy its line charge assemblies in the proper overlap zone. If there is (are) "dud" fuze(s) in the just-cleared area, the deploying watercraft could be positioned over undetonated line charges when in the overlap zone. Accordingly, it is imperative that undetonated line charges be prevented from sympathetic detonation in the overlap zone even when a line charge assembly's fuze is a dud.

SUMMARY OF THE INVENTION

Accordingly, it is an object of the present invention to provide a line charge assembly and system for use in shallow-water obstruction clearing operations.

Another object of the present invention is to provide a line charge assembly that can be reliably detonated in accordance with specified conditions.

Still another object of the present invention is to provide a line charge assembly that is reliably "safed" in its pre-use condition and in its dud condition.

Yet another object of the present invention is to provide a line charge assembly and system that is equipped to prevent sympathetic detonation of line charges in at least a portion of the line charge when the line charge assembly's fuze is a dud.

Other objects and advantages of the present invention will become more obvious hereinafter in the specification and drawings.

In accordance with the present invention, a line charge assembly and system are provided for use in a shallow-water obstruction clearing operation. Each assembly has a propulsion unit capable of flight through the air, a line charge array, an air-safed water-armed fuze, a first interrupter disposed between the line charge array and the fuze, and a second interrupter disposed in the line charge array. The propulsion unit pulls the line charge array, the interrupter and fuze through the air to a water destination. The line charge array is defined by a plurality of line charges successively coupled to one another by a detonation line capable of transferring detonation energy therealong successively to each line charge. The line charge array has a first end coupled to the propulsion unit and has a second end coupled to the first interrupter. The air-safed water-armed fuze generates the detonation energy at the expiration of a first time period provided the fuze is in water. The first interrupter permits the detonation energy to be transferred from the fuze to the second end of the line charge array until the expiration of a second time period, and then prohibits the detonation energy to be transferred from the fuze to the second end after the expiration of the second time period. The second interrupter permits the detonation energy to be transferred therethrough until the expiration of a third time period, and then prohibits the detonation energy to be transferred therethrough after the expiration of the third time period. The first time period commences when the propulsion unit begins to pull the fuze through the air, the second time period commences when the propulsion unit begins to pull the first interrupter through the air and the third time period commences when the propulsion unit begins to pull the second interrupter through the air. The assembly is configured so that the first time period expires before the expiration of the second and third time periods, both of which can expire approximately simultaneously. In use, a plurality of the line charge assemblies are deployed and detonated in an area. The first interrupter operates independently of the fuze to essentially sterilize a dud fuze. The second interrupter operates independently of the fuze and first interrupter to prevent the back propagation of sympathetic detonation energy to any of the assembly's line charges that reside between it's fuze and the first interrupter in the case where the fuze is a dud.

DETAILED DESCRIPTION OF THE INVENTION

Figure 1:
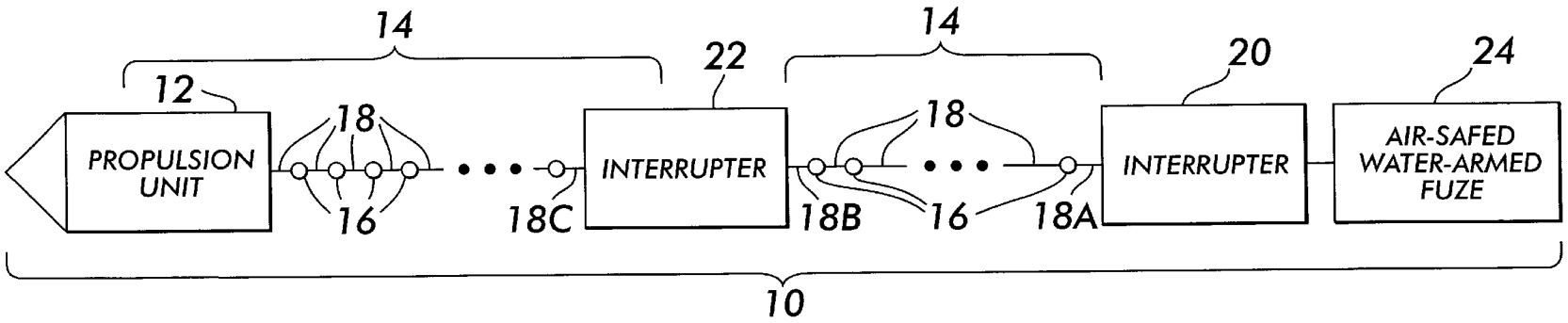
FIG. 1 is a schematic representation of a line charge assembly according to the present invention.

Referring now to the drawings, and more particularly to FIG. 1, a line charge assembly according to the present invention is shown and referenced generally by numeral 10. Line charge assembly 10 is shown in its deployed state. That is, prior to deployment, line charge assembly 10 is stored in a container (not shown) and launched therefrom. The container is transported to its deployment destination by a surface ship (not shown) as will be explained further below.

Line charge assembly 10 includes a propulsion unit 12 which typically is a rocket. Tethered to propulsion unit 12 is a line charge array 14 consisting of a plurality of line charges 16 successively tethered to one another by a detonation cord or line 18. Line charges 16 are any explosive device that uses non-primary energetic explosive material requiring a high energy event for initiation. The necessary high energy event is transferred along detonation line 18 as will be explained further below. That is, detonation line 18 is representative of any coupling mechanism that can tether two successive line charges 16 to one another and transfer detonation energy therealong. The particular choices for line charges 16 and detonation line 18 are not limitations of the present invention. In addition, although not shown for clarity of illustration, line charges 16 will be mechanically tethered to one another by a strong lightweight material/cord such as a nylon web cord as is well known in the art.

Disposed in line charge array 14 are two interrupters 20 and 22. The first interrupter 20 is positioned at the end of line charge array 14 and the second interrupter 22 is positioned between two successive line charges 16. More specifically, interrupter 20 is a disruptable detonation coupling between the last detonation line segment 18A and an air-safed water-armed fuze 24. Interrupter 22 is a disruptable detonation coupling between detonation line segment 18B and detonation line segment 18C. At this point in the description, it is sufficient to say that actuation of either interrupter 20 or 22 creates an opening in detonation line 18 across which detonation energy cannot propagate.

Air-safed water-armed fuze 24 generates the detonation energy for line charge array 14 only under certain conditions. The specific three conditions required for the generation of the detonation energy are deployment of line charge assembly 10 (i.e., propulsion unit 12 has been launched into the air and is pulling line charge array 14, interrupters 20/22 and fuze 24 through the air), the lapse of specified time period after deployment, and the immersion of fuze 24 in water. If the deployment condition is not met, fuze 24 remains in a safe mode. If the deployment condition is met, but the water condition is not met by the expiration of the specified time period, fuze 24 remains in the safe mode. If all conditions are met, fuze 24 generates detonation energy and supplies same to interrupter 20 which, if not actuated, transfers the detonation energy to line charge array 14. The detonation energy propagates along detonation line 18 (from fuze 24 towards propulsion unit 12) to successively detonate line charges 16. The detonation energy will be transferred through interrupter 22 provided actuation thereof has not occurred.

The use of line charge assembly 10 in a system for clearing a shallow-water area of obstructions (e.g., mines, underwater debris, underwater foliage, etc.) will now be explained with the aid of FIG. 2. In general, the clearing operation is designed to open a lane of unobstructed travel through a shallow-water area 100 to a beach 102. The method for accomplishing such lane clearing proceeds generally as follows. Since shallow-water area 100 frequently extends out from beach 102 for great distances the clearing of a lane is typically done in segments. Accordingly, each of a set of line charge assemblies 10 are deployed and detonated over a relatively small area to be cleared. After the covered area's line charge assemblies 10 are detonated in the water, another set are deployed over a next sequential area. To insure adequate clearing of obstructions, each area to be cleared should partially overlap the previously cleared area. This process continues from a point out in the open water up to beach 102.

Figure 2:
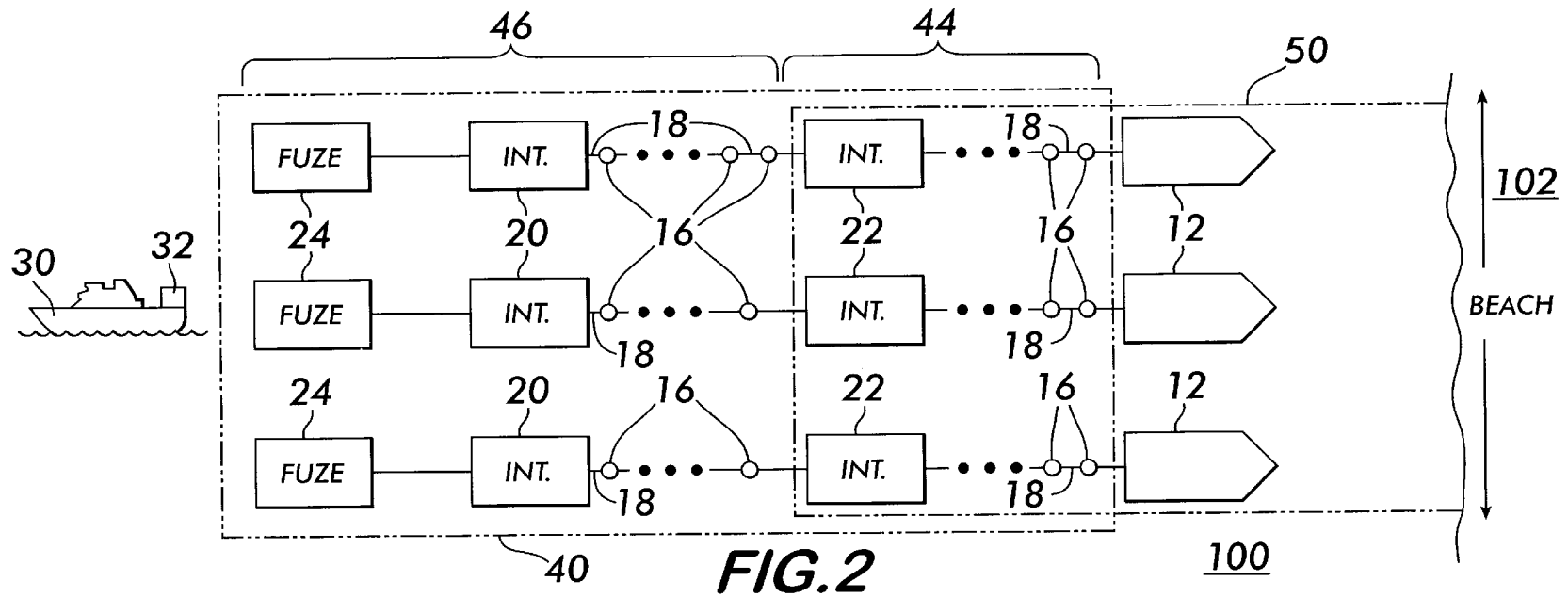
FIG. 2 is a schematic view of a line charge system and deployment scenario using a plurality of line charge assemblies according to the present invention.

Referring now more specifically to FIG. 2, an example of the above-described general process will be explained. A watercraft 30 transports a plurality of the above-described line charge assemblies 10 in a container 32 to shallow-water area 100. Each of the line charge assemblies can be launched individually and on-command from container 32. Such launching techniques and systems therefor are well known in the art and will not be described further herein. Each line charge assembly's fuze 24 is configured to detonate once in the water. After such detonation, another of the line charge assemblies is deployed/detonated at a location in area 40 that is adjacent to the most recently detonated line charge assembly. Note that if a particular line charge assembly does not detonate because of a dud fuze, the process of deploying additional line charge assemblies continues as if detonation occurred while the undetonated line charge assembly remains in place in the water.

FIG. 2 depicts a scenario where a plurality of line charge assemblies 10 have been deployed in an area defined by dotted lines 40. For purpose of illustration, the line charge assemblies 10 are illustrated as if they had not been detonated in order to show their relative pre-detonation relationship to one another in area 40. However, in practice, each of the line charge assemblies is detonated before the next adjacent one is deployed. Through the use of well known aiming and launching techniques, line charge assemblies 10 are deployed in an approximately side-by-side fashion such that the positions of interrupters 22 are arrayed across area 40 at known locations thereby defining a portion 46 of area 40 which will be explained further below.

Once deployed in water as shown, each of assemblies 10 should detonate automatically thereby leaving area 40 clear of all line charges 16 and, ideally, any obstructions in area 40. As mentioned above, to insure a successful clearing operation, watercraft 30 launches its next set of line charge assemblies (not shown) into a next successive area (represented by dashed lines 50) that partially overlaps area 40 at an overlap area 44. The amount of overlap is a design choice and is not a limitation of the present invention. However, the amount of overlap desired does determine the relative position of interrupter 22 in line charge array 14.

As mentioned above, interrupters 20 and 22 only permit the transfer of detonation energy until they are actuated. For proper operation of the present invention, the detonation energy for each successive line charge 16 must come from the direction of fuze 24. If fuze 24 is a dud, an actuated interrupter 20 isolates fuze 24 from it's line charge array so that any subsequent and unwanted actuation of fuze 24 would not affect the line charge array. Thus, interrupter 20 effectively acts to sterilize fuze 24 while operating independently thereof. If fuze 24 is a dud, an actuated interrupter 22 prevents denotation energy that is somehow supplied to any of line charges 16 between interrupter 22 and propulsion unit 12 from passing from segment 18C to segment 18B.

The importance of interrupter 22 is that it provides a safety factor for watercraft 30 when it is time to position itself for deployment of the next set of line charge assemblies, i.e., into area 50 in the illustrative example. In order to properly place the line charge assemblies, it may be necessary for watercraft 30 to position itself in some portion 46 of area 40 that is adjacent area 50. However, if one (or more) fuze 24 deployed in area 40 is a dud, watercraft 30 is at risk of being positioned over undetonated line charges 16. The risk to watercraft 30 is not due to a dud fuze 24 as it is effectively sterilized by an actuated interrupter 20 prior to the entry of watercraft 30 into area 46. Such sterilization prevents the subsequent transfer of detonation energy from the dud fuze 24 to it's line charges 16 in area 46. Instead, the risk to watercraft 30 is that some high energy event occurring in area 44 will set off a line charge 16 in area 44 and cause the propagation of resulting detonation energy back toward area 46. The purpose of interrupter 22 is to prevent detonation energy from the sympathetic detonation of any of line charges 16 in overlap area 44 from propagating back into area 46 which could jeopardize watercraft 30 during the deployment of line charge assemblies in area 50.

Figure 3:
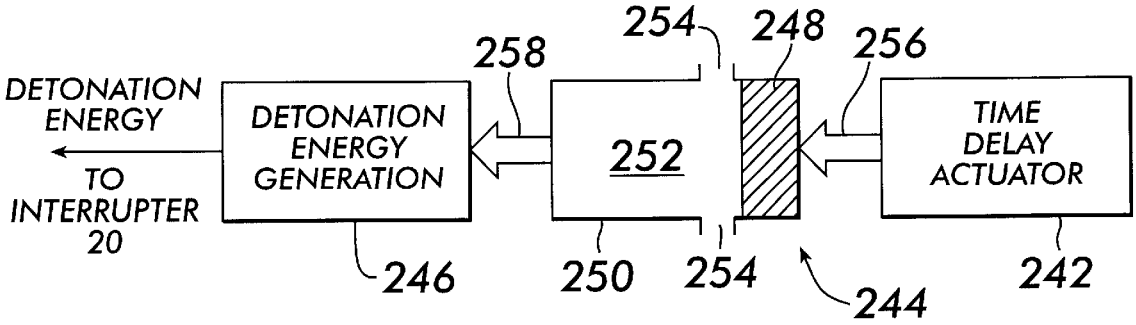
FIG. 3 is a schematic view of one embodiment of an air-safed water-armed fuze used in each line charge assembly.

An embodiment of fuze 24 will now be described generally with the aid of FIG. 3. The functional portions of fuze 24 include a time delay actuator 242, a piston assembly 244 and a detonator energy generation block 246 coupled to interrupter 20. Piston assembly 244 has a piston 248 slidably fitted in a cylinder 250 at one end thereof to define a chamber 252 therein. Chamber 252 is provided with one or more vents 254 that allow chamber 252 to communicate, i.e., fill, with fluid (not shown) from a surrounding fluid environment, i.e., air or water.

In operation, fuze 24 will begin its flight through the air when its line charge assembly is deployed under the power of its propulsion unit as described above. When the flight of fuze 24 commences, time delay actuator 242 is initiated to begin its time delay function. At the conclusion of actuator 242's time delay period, actuator 242 generates an actuating force 256 applied to piston 248 thereby causing piston 248 to move in cylinder 250 and seal off vents 254. Continued movement of piston 248 compresses the fluid in chamber 252. Such compression translates into another actuating force 258. The size of force 258 depends on the fluid in chamber 252. Specifically, if chamber 252 is filled with air, force 252 is very small owing to the air's compressibility. However, if chamber 252 is filled with water (as it would be when fuze 24 enters the water), force 258 is much greater owing to the incompressibility of water. Detonation energy generation block 246 is designed to be sensitive/responsive only to the greater amount of force 258, i.e., when chamber 252 is filled with water. In such a case, block 246 generates detonation energy which is passed to interrupter 20.

Figure 4:
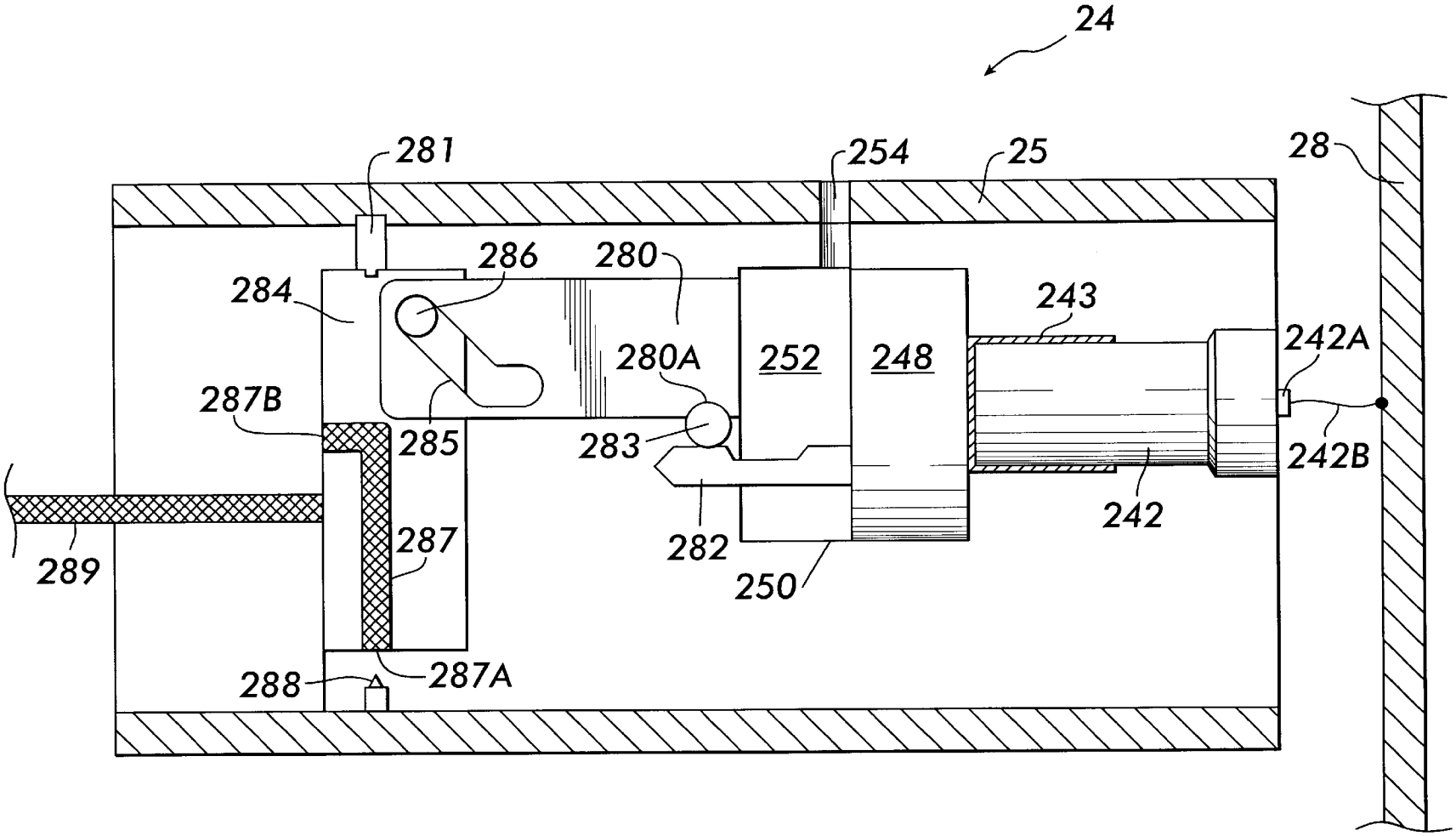
FIG. 4 is a cutaway view of a specific implementation of the fuze.

A specific implementation for carrying out the functions of fuze 24 will be described by way of example with the aid of FIG. 4 where like reference numerals will be used where appropriate. It is to be understood that only the essential structural features of fuze 24 are depicted for clarity of illustration. A housing 25 supports and protects the various elements of fuze 24. Time delay actuator 242 is mounted in housing 25 and can be realized by a small column insulated delay (SCID) that produces a gas output at the conclusion of its time delay period. SCIDs of this type are available commercially from Teledyne McCormick-Selph Inc., Hollister, Calif. Typically, as is known in the art, a SCID-type of actuator 242 has an initiating shaft 242A that initiates the time delay action when the shaft is pulled out and allowed to snap back. Accordingly, shaft 242A has a short lanyard 242B coupled thereto and attached to, for example, a wall 28 of a launch tube (not shown). When fuze 24 is pulled away from wall 28 during deployment, shaft 242A is pulled until lanyard 242B breaks, at which point shaft 242A snaps back.

At the conclusion of the time delay of actuator 242, a gas output is generated and supplied to a small chamber 243 in communication with piston 248. Piston 248 operates in cylinder 250 as described above. Chamber 252 communicates with an arming piston 280 held in position by a shear pin 281 and by a piston locking mechanism to prevent inadvertent movement of piston 280 at all times except when actuator 242 times out and fuze 24 is in water. The locking mechanism can be realized by a locking arm 282 extending from piston 248 and alongside piston 280. Piston 280 is provided with a notch 280A receiving a ball lock 283 as positioned by locking arm 282. When piston 248 is driven through cylinder 250, locking arm 282 advances and allows ball lock 283 to disengage from piston 280. During this time, piston 280 is free to be acted on by the force generated in chamber 252. If chamber 252 is filled with water, the force acting on piston 280 is sufficient to break shear pin 281 thereby allowing piston 280 to move to the left in the figure. If chamber 252 is filled with air, the force acting on piston 28 is insufficient to break shear pin 281. Further, piston 248 will continue to move to the left thereby causing locking arm 282 to again press ball lock 283 into notch 280A and again safe fuze 24.

Assuming chamber 252 is filled with water so that piston 280 moves to the left, fuze 24 proceeds to generate detonation energy as follows. Piston 280 is coupled to a slider block 284 by means of a slot 285 in piston 280 and a post 286 extending from block 284 into slot 285. Leftward movement of piston 280 causes transverse movement of block 284.

Disposed in slider block 284 is a run 287 of energetic material that will detonate upon impact. Run 287 is shaped to transfer detonation energy along run 287 to a detonation train 289 that transfers detonation energy to interrupter 20. The necessary impact to initiate run 287 is brought about by the above-described transverse movement of block 284. Specifically, the transverse sliding movement causes one end 287A of run 287 to impact a firing pin 288. Simultaneously, such movement positions the other end 287B of run 287 in line with detonation train 289 leading to interrupter 20.

Proper operation of fuze 24 is designed to take place prior to the actuation of either of interrupters 20 and 22 so Navy's current design approach for lane clearing operations. The use of interrupters operating independently of each line charge array's fuze simplifies the construction of the fuze and, therefore, improves the fuze's reliability. One interrupter essentially acts to sterilize the fuze while the other will prevent the back propagation of detonation energy in a sympathetic detonation scenario. The unique air-safe water-armed fuze provides a high degree of detonation reliability, while the use of independent sterilization mechanisms prevent both inadvertent and late detonation problems.

Although the invention has been described relative to a specific embodiment thereof, there are numerous variations and modifications that will be readily apparent to those skilled in the art in light of the above teachings. For example, each line charge array could have more than one interrupter functioning like interrupter 22. In this way, each line charge assembly could be used in a variety of different deployment overlap scenarios (i.e., more or less overlap) to provide a greater degree of flexibility for a given application. One example where this would be of value is where adjacent areas to be cleared are at an angle with respect to one another as is the case when a lane to be cleared must be curved. When meeting at an angle, one side of an overlap area will be larger than the other side of the overlap area thereby necessitating different placement of interrupter 22. It is therefore to be understood that, within the scope of the appended claims, the invention may be practiced other than as specifically described. shown coupled to booster 210. Specifically, a SCID-type actuator 216 supported in housing 202 is coupled to a ram piston assembly consisting essentially of a cylinder 218, a piston 220 slidably mounted in cylinder 218, and a displacement arm 222 extending from piston 220. SCID-type actuator 216 operates identically to actuator 242 and, accordingly, has an initiating shaft 216A that initiates the actuator's time delay when shaft 216A is pulled out and then allowed to snap back. A lanyard 216B is coupled to shaft 216A and to some fixed portion of a launch platform (not shown). When interrupter 20 is launched along with its line charge array, shaft 216A is pulled until lanyard 216B breaks, at which point shaft 216A snaps back to start the actuator's time delay. The time delay for actuator 216 should be configured so that actuator 216 "times out" after actuator 242 times out. In this way, interrupter 20 is only actuated after fuze 24 has had time to operate properly as described above. At the conclusion of the time delay of actuator 216, a gas output is generated and applied to piston 220 whereby piston 220 drives displacement arm 222 so that booster 210 is moved out of detonation alignment with booster 208 and detonation line 212.

Both of interrupters 20 and 22 will activate only after fuze 24 has had time to operate properly. However, if interrupters 20 and 22 are identical in construction, interrupter 22 will initiate and reach its time delay period just slightly before interrupter 20 since interrupter 22 is positioned forward of interrupter 20 and will, therefore, be initiated before interrupter 20.

The advantages of the present invention are numerous. The line charge assembly and system provide a safe and reliable means for clearing a path through a surf zone. The particular arrangement of elements is ideally suited for the that the detonation energy generated by fuze 24 is properly transferred along line charge array 14. Thus, interrupters 20 and 22 must be configured to actuate only after the proper time has lapsed for proper operation of fuze 24. Further, if fuze 24 is a dud, interrupter actuation must be reliable for overall system safety. Accordingly, a simple interrupter assembly with a reliable time delay operation is required. While a variety of constructions are possible, one simple and reliable interrupter will be described herein.

Figure 5:
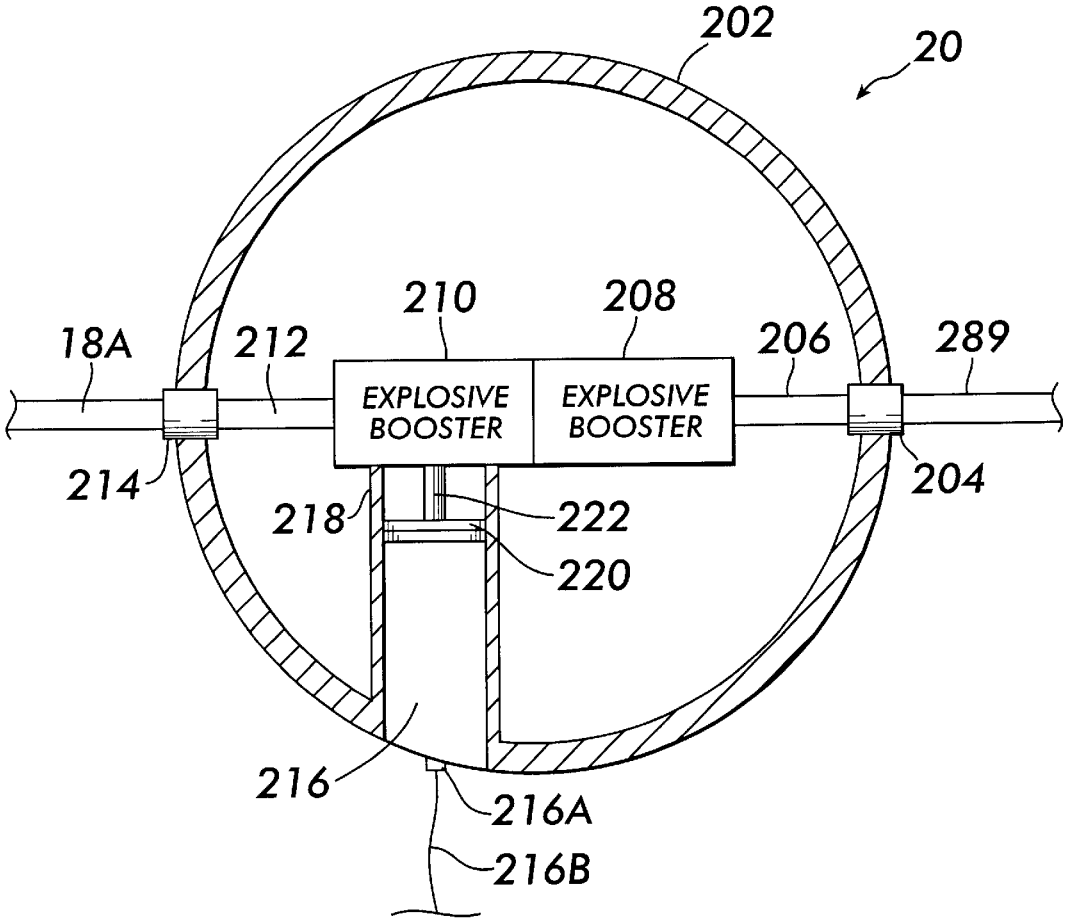
FIG. 5 is a schematic view of a specific implementation of an interrupter in accordance with the present invention.

To simplify construction and minimize the chance of assembly errors, each of interrupters 20 and 22 is preferably constructed in the same fashion so that a description of interrupter 20 will also apply to interrupter 22. Referring now to FIG. 5, interrupter 20 is shown only with its functional components for clarity of illustration. Interrupter 20 typically is constructed with a waterproof housing 202 that also serves as the point of mechanical coupling to fuze 24 and line charge array 14. Prior to actuation of interrupter 20, a detonation train is defined in housing 202 to provide a detonation coupling between detonation train 289 and segment 18A of the line charge array's detonation line 18. Specifically, detonation train 289 is coupled to a detonation line 206 through a waterproof coupling 204. Detonation line 206 is coupled to in-line explosive boosters 208 and 210. Explosive booster 210 is coupled to a detonation line 212 that is, in turn, coupled to segment 18A via waterproof coupling 214.

Actuation of interrupter 20 entails the disruption of the above-described detonation train by, for example, displacing explosive booster 210 so that it is no longer in a detonating alignment with booster 208 and detonation line 212. One type of simple and reliable displacement mechanism is

What is claimed as new and desired to be secured by Letters Patent of the United States is:

1. A line charge assembly for use in a shallow-water obstruction clearing operation, comprising;

a propulsion unit capable of flight through the air;

a line charge array defined by a plurality of line charges successively coupled to one another by a detonation line capable of transferring detonation energy therealong successively to each of said plurality of line charges, said line charge array having a first end coupled to said propulsion unit and having a second end;

an air-safed water-armed fuze for generating said detonation energy at the expiration of a first time period provided said fuze is in water;

first means coupling said fuze to said second end for permitting said detonation energy to be transferred from said fuze to said second end until the expiration of a second time period and for prohibiting said detonation energy to be transferred from said fuze to said second end after the expiration of said second time period;

second means in line with said detonation line between said first end and said second end for permitting said detonation energy to be transferred therethrough until the expiration of a third time period and for prohibiting said detonation energy to be transferred therethrough after the expiration of said third time period;

wherein said propulsion unit pulls said line charge array, said second means, said first means and said fuze through the air to a water destination; and said first time period commencing when said propulsion unit begins to pull said fuze through the air, said second time period commencing when said propulsion unit begins to pull said first means through the air and said third time period commencing when said propulsion unit begins to pull said second means through the air, wherein said first time period expires before the expiration of said second time period and said third time period.

2. A line charge assembly as in claim 1 wherein said propulsion unit is a rocket.

3. A line charge assembly as in claim 1 wherein said air-safed water-armed fuze comprises;

a housing;

a cylinder defined in said housing;

a piston slidably mounted in said cylinder wherein a chamber is defined on one side of said piston, said chamber having at least one vent communicating with a surrounding fluid environment wherein said chamber is filled with fluid from said surrounding fluid environment;

a time delay actuator for providing an actuating force to said piston at the expiration of said first time period wherein said piston slides in said cylinder, seals said at least one vent and acts on said fluid in said chamber; and detonation means coupled to said chamber and responsive to movement of said piston to generate said detonation energy only when said fluid is water.

4. A line charge assembly as in claim 3 wherein said time delay actuator is a small column insulated delay.

5. A line charge assembly as in claim 3 wherein said detonation means comprises:

a second piston mounted in said housing for sliding movement therein, said second piston having a piston face exposed to said chamber wherein said second piston undergoes sliding movement when said fluid is water;

a block slidingly mounted in said housing and coupled to said second piston, wherein said sliding movement of said second piston causes a transverse sliding movement of said block;

a detonation train disposed in said block; and a firing pin mounted in said housing for striking said detonation train when said block undergoes said transverse sliding movement, wherein said detonation train is initiated to generate said detonation energy.

6. A line charge assembly as in claim 1 wherein said first means comprises:

a plurality of detonation boosters arranged in an alignment with one another for transferring said detonation energy therethrough; and means coupled to one of said plurality of detonation boosters for disrupting said alignment at the expiration of said second time period.

7. A line charge assembly as in claim 6 wherein said means for disrupting comprises:

a small column insulated delay (SCID) configured to be initiated when said propulsion unit begins to pull said first means through the air wherein said second time period commences, said SCID generating an actuating force at the expiration of said second time period; and a piston assembly coupled to said SCID to receive said actuating force and generate a displacement force in response thereto, said piston assembly further coupled to said one of said plurality of detonation boosters for applying said displacement force to said one of said plurality of detonation boosters.

8. A line charge assembly as in claim 1 wherein said second means comprises:

a plurality of detonation boosters arranged in an alignment with one another for transferring said detonation energy therethrough; and means coupled to one of said plurality of detonation boosters for disrupting said alignment at the expiration of said third time period.

9. A line charge assembly as in claim 8 wherein said means for disrupting comprises:

a small column insulated delay (SCID) configured to be initiated when said propulsion unit begins to pull said second means through the air wherein said third time period commences, said SCID generating an actuating force at the expiration of said third time period; and a piston assembly coupled to said SCID to receive said actuating force and generate a displacement force in response thereto, said piston assembly further coupled to said one of said plurality of detonation boosters for applying said displacement force to said one of said plurality of detonation boosters.

10. A line charge system for use in a shallow-water obstruction clearing operation, comprising;

a deployment watercraft;

a plurality of line charge assemblies maintained onboard said deployment watercraft for deployment therefrom, each of said plurality of line charge assemblies comprising a propulsion unit capable of flight through the air;

a line charge array defined by a plurality of line charges successively coupled to one another by a detonation line capable of transferring detonation energy therealong successively to each of said plurality of line charges, said line charge array having a first end coupled to said propulsion unit and having a second end;

an air-safed water-armed fuze for generating said detonation energy at the expiration of a first time period provided said fuse is in water;

first means coupling said fuze to said second end for permitting said detonation energy to be transferred from said fuze to said second end until the expiration of a second time period and for prohibiting said detonation energy to be transferred from said fuze to said second end after the expiration of said second time period;

second means in line with said detonation line between said first end and said second end for permitting said detonation energy to be transferred therethrough until the expiration of a third time period and for prohibiting said detonation energy to be transferred therethrough after the expiration of said third time period;

wherein said propulsion unit pulls said line charge array, said second means, said first means and said fuze through the air to a water destination; and said first time period commencing when said propulsion unit begins to pull said fuze through the air, said second time period commencing when said propulsion unit begins to pull said first means through the air and said third time period commencing when said propulsion unit begins to pull said second means through the air, wherein said first time period expires before the expiration of said second time period and said third time period and wherein, when said plurality of said line charge assemblies are deployed side-by-side over an area, a plurality of said second means from said plurality of line charge assemblies are arrayed across said area.

11. A line charge system as in claim 10 wherein said propulsion unit is a rocket.

12. A line charge system as in claim 10 wherein said air-safed water-armed fuze comprises:

a housing;

a cylinder defined in said housing;

a piston slidably mounted in said cylinder wherein a chamber is defined on one side of said piston, said chamber having at least one vent communicating with a surrounding fluid environment wherein said chamber is filled with fluid from said surrounding fluid environment;

a time delay actuator for providing an actuating force to said piston at the expiration of said first time period wherein said piston slides in said cylinder, seals said at least one vent and acts on said fluid in said chamber; and detonation means coupled to said chamber and responsive to movement of said piston to generate said detonation energy only when said fluid is water.

13. A line charge system as in claim 12 wherein said time delay actuator is a small column insulated delay.

14. A line charge system as in claim 12 wherein said detonation means comprises:

a second piston mounted in said housing for sliding movement therein, said second piston having a piston face exposed to said chamber wherein said second piston undergoes sliding movement when said fluid is water;

a block slidingly mounted in said housing and coupled to said second piston, wherein said sliding movement of said second piston causes a transverse sliding movement of said block;

a detonation train disposed in said block; and a firing pin mounted in said housing for striking said detonation train when said block undergoes said transverse sliding movement, wherein said detonation train is initiated to generate said detonation energy.

15. A line charge system as in claim 10 wherein said first means comprises:

a plurality of detonation boosters arranged in an alignment with one another for transferring said detonation energy therethrough; and means coupled to one of said plurality of detonation boosters for disrupting said alignment at the expiration of said second time period.

16. A line charge system as in claim 15 wherein said means for disrupting comprises:

a small column insulated delay (SCID) configured to be initiated when said propulsion unit begins to pull said first means through the air wherein said second time period commences, said SCID generating an actuating force at the expiration of said second time period; and a piston assembly coupled to said SCID to receive said actuating force and generate a displacement force in response thereto, said piston assembly further coupled to said one of said plurality of detonation boosters for applying said displacement force to said one of said plurality of detonation boosters.

17. A line charge system as in claim 10 wherein said second means comprises:

a plurality of detonation boosters arranged in an alignment with one another for transferring said detonation energy therethrough; and means coupled to one of said plurality of detonation boosters for disrupting said alignment at the expiration of said third time period.

18. A line charge system as in claim 17 wherein said means for disrupting comprises:

a small column insulated delay (SCID) configured to be initiated when said propulsion unit begins to pull said second means through the air wherein said third time period commences, said SCID generating an actuating force at the expiration of said third time period; and a piston assembly coupled to said SCID to receive said actuating force and generate a displacement force in response thereto, said piston assembly further coupled to said one of said plurality of detonation boosters for applying said displacement force to said one of said plurality of detonation boosters.

19. A line charge system for use in a shallow-water obstruction clearing operation, comprising;

a plurality of line charge assemblies, each of said plurality of line charge assemblies comprising a propulsion unit capable of flight through the air;

a line charge array defined by a plurality of line charges successively coupled to one another by a detonation line capable of transferring detonation energy thereal-ong successively to each of said plurality of line charges, said line charge array having a first end coupled to said propulsion unit and having a second end;

an air-safed water-armed fuze for generating said detonation energy at the expiration of a first time period provided said fuse is in water;

first means coupling said fuze to said second end for permitting said detonation energy to be transferred from said fuze to said second end until the expiration of a second time period and for prohibiting said detonation energy to be transferred from said fuze to said second end after the expiration of said second time period;

second means in line with said detonation line between said first end and said second end for permitting said detonation energy to be transferred therethrough until the expiration of a third time period and for prohibiting said detonation energy to be transferred therethrough after the expiration of said third time period;

wherein said propulsion unit pulls said line charge array, said second means, said first means and said fuze through the air to a water destination; and said first time period commencing when said propulsion unit begins to pull said fuze through the air, said second time period commencing when said propulsion unit begins to pull said first means through the air and said third time period commencing when said propulsion unit begins to pull said second means through the air, wherein said first time period expires before the expiration of said second time period and said third time period and wherein, when said plurality of said line charge assemblies are deployed side-by-side over an area, a plurality of said second means from said plurality of line charge assemblies are arrayed across said area.

20. A line charge system as in claim 19 wherein said propulsion unit is a rocket.

21. A line charge system as in claim 19 wherein said air-safed water-armed fuze comprises:

a housing;

a cylinder defined in said housing;

a piston slidably mounted in said cylinder wherein a chamber is defined on one side of said piston, said chamber having at least one vent communicating with a surrounding fluid environment wherein said chamber is filled with fluid from said surrounding fluid environment;

a time delay actuator for providing an actuating force to said piston at the expiration of said first time period wherein said piston slides in said cylinder, seals said at least one vent and acts on said fluid in said chamber; and detonation means coupled to said chamber and responsive to movement of said piston to generate said detonation energy only when said fluid is water.

22. A line charge system as in claim 21 wherein said time delay actuator is a small column insulated delay.

23. A line charge system as in claim 21 wherein said detonation means comprises:

a second piston mounted in said housing for sliding movement therein, said second piston having a piston face exposed to said chamber wherein said second piston undergoes sliding movement when said fluid is water;

a block slidingly mounted in said housing and coupled to said second piston, wherein said sliding movement of said second piston causes a transverse sliding movement of said block;

a detonation train disposed in said block; and a firing pin mounted in said housing for striking said detonation train when said block undergoes said transverse sliding movement, wherein said detonation train is initiated to generate said detonation energy.

24. A line charge system as in claim 19 wherein said first means comprises:

a plurality of detonation boosters arranged in an alignment with one another for transferring said detonation energy therethrough; and means coupled to one of said plurality of detonation boosters for disrupting said alignment at the expiration of said second time period.

25. A line charge system as in claim 24 wherein said means for disrupting comprises:

a small column insulated delay (SCID) configured to be initiated when said propulsion unit begins to pull said first means through the air wherein said second time period commences, said SCID generating an actuating force at the expiration of said second time period; and a piston assembly coupled to said SCID to receive said actuating force and generate a displacement force in response thereto, said piston assembly further coupled to said one of said plurality of detonation boosters for applying said displacement force to said one of said plurality of detonation boosters.

26. A line charge system as in claim 19 wherein said second means comprises:

a plurality of detonation boosters arranged in an alignment with one another for transferring said detonation energy therethrough; and means coupled to one of said plurality of detonation boosters for disrupting said alignment at the expiration of said third time period.

27. A line charge system as in claim 26 wherein said means for disrupting comprises:

a small column insulated delay (SCID) configured to be initiated when said propulsion unit begins to pull said second means through the air wherein said third time period commences, said SCID generating an actuating force at the expiration of said third time period; and a piston assembly coupled to said SCID to receive said actuating force and generate a displacement force in response thereto, said piston assembly further coupled to said one of said plurality of detonation boosters for applying said displacement force to said one of said plurality of detonation boosters.

* * * * *